US006361046B1

(12) United States Patent
Rothman

(10) Patent No.: US 6,361,046 B1
(45) Date of Patent: Mar. 26, 2002

(54) MARBLE/DISK GAME

(76) Inventor: Benjamin Rothman, 145 Probasco Rd., East Windsor, NJ (US) 08520

( * ) Notice: Subject to any disclaimer, the term of this patent is extended or adjusted under 35 U.S.C. 154(b) by 0 days.

(21) Appl. No.: 09/506,641

(22) Filed: Feb. 18, 2000

(51) Int. Cl.[7] ..... A63F 3/00

(52) U.S. Cl. ..... 273/236; 273/124 R; 273/125 R; 273/110; 273/113

(58) Field of Search ..... 273/236, 124 R, 273/125 R, 110, 113

(56) References Cited

U.S. PATENT DOCUMENTS 517,715 A * 4/1894 Woebs ..... 273/124
593,766 A * 11/1897 Derwin ..... 273/124
600,086 A * 3/1898 Lufsky ..... 273/125 R
638,991 A * 12/1899 Requarth ..... 273/124
661,163 A * 11/1900 Young ..... 273/124
867,841 A * 10/1907 Savidge ..... 273/124
930,164 A * 8/1909 Eberman ..... 273/124
936,785 A * 10/1909 Kruse ..... 273/124
985,788 A * 3/1911 Deming ..... 27/124
1,039,133 A * 9/1912 Hutton ..... 273/124
1,305,341 A * 6/1919 Chung ..... 273/124
1,359,108 A * 11/1920 Rowland ..... 273/124
1,557,014 A * 10/1925 Bohn ..... 273/124
1,889,899 A * 12/1932 Langenhaun ..... 273/124
D89,047 S * 1/1933 Lessig et al. ..... 273/125 R
1,947,125 A * 2/1934 Pew ..... 273/124
1,947,127 A * 2/1934 Pew ..... 273/124
D94,466 S * 2/1935 Campbell et al. ..... 273/125 R
2,636,740 A * 4/1953 McNeal ..... 273/118
3,603,589 A * 9/1971 Sonntag ..... 273/95 R
3,653,665 A * 4/1972 Wahlberg ..... 273/125 R
3,947,034 A * 3/1976 Waters ..... 273/123 R
3,985,355 A * 10/1976 Shoemaker ..... 273/3 A
4,058,315 A * 11/1977 Guise, Jr. ..... 273/118 R
D251,139 S * 2/1979 Kroll ..... D34/5 SS
4,190,251 A * 2/1980 Hall ..... 273/124 R
4,549,737 A * 10/1985 Seyer et al. ..... 273/118 R
D327,099 S * 6/1992 Hodges ..... D21/17
5,647,595 A * 7/1997 Knickerbocker ..... 273/118 R

* cited by examiner

*Primary Examiner*—Benjamin H. Layno
*Assistant Examiner*—Dolores R. Collins
(74) *Attorney, Agent, or Firm*—Watov & Kipnes, P.C.; Kenneth Watov

(57) ABSTRACT

A marble game is described in which a playing surface is provided having designations for the locations of two marbles in contact with each other and with designations of a plurality of shooting positions for a third marble, these being points awarded a player for a shot from each shooting position that dislodges one of the two marbles without dislodging or moving the other. Alternatively, the marbles can be replaced by disk objects, such as dimes or pennies.

25 Claims, 3 Drawing Sheets

MARBLE/DISK GAME

BACKGROUND OF THE INVENTION

In years gone by, there was great enthusiasm for a marble game in which the object was to knock marbles initially positioned in the center of an eight-foot ring outside of the ring by shooting a marble held between the thumb and fingers with an outward snap of the thumb. For such a game to be feasible an absolutely level ring, usually formed with clay soil was provided by public parks and business enterprises. Unfortunately such rings are no longer available.

SUMMARY OF THE INVENTION

In accordance with one embodiment of this invention, a game is provided in which the marble shooting accuracies of players can be respectively compared without requiring a large clay ring. Two marbles are placed in contact with each other on a level playing surface, and the players shoot a shooter marble from designated shooting positions on the surface so as to move one of them without moving the other. For a successful shot from each position a player earns a number of points related to the difficulty involved. After a preselected number of shots, the winner is the player with the most points. Alternatively, in another embodiment of the invention, the marbles can be replaced with disk objects, such as dimes, or pennies. Also, the playing surface can be made portable.

DETAILED DESCRIPTION OF THE INVENTION

Figure 1A:
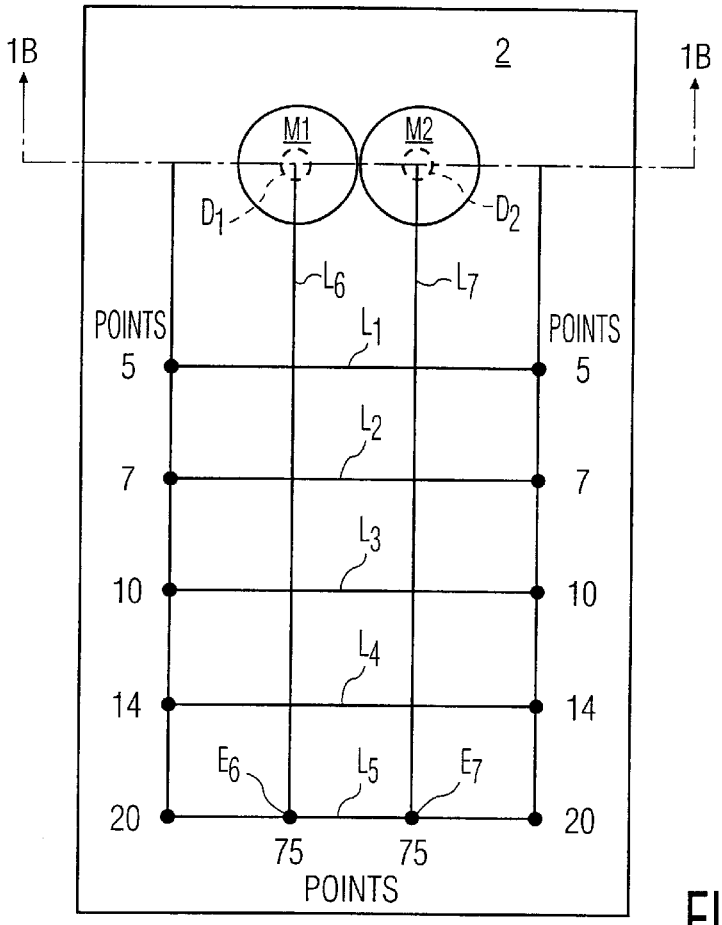
FIG. 1A is a top view of a playing surface on which two marbles or disk objects are shown in playing position.
Figure 1B:
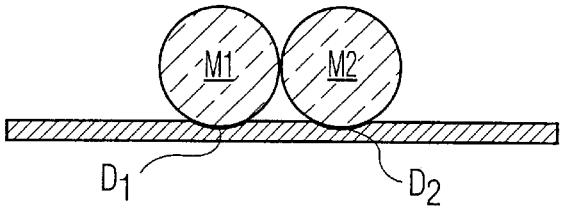
FIG. 1B is a section BB of FIG. 1A when the playing surface is hard.
Figure 1C:
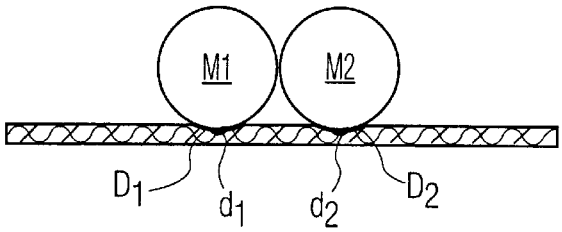
FIG. 1C illustrates a section BB of FIG. 1B if the playing surface is soft.

In FIG. 1A, a smooth flat playing surface 2 is shown having marbles $M_1$ and $M_2$, preferably of identical weight and size, mounted thereon in contact with each other. As shown in the FIGS. 1B and 1C, the marbles $M_1$ and $M_2$ are respectively mounted in depressions $D_1$ and $D_2$ formed in the playing surface 2. If the playing surface 2 is made of hard material such as plastic, the depressions $D_1$ and $D_2$ are preformed therein as shown in FIG. 1B, but if the playing surface 2 is made of soft material such as felt, the depressions $D_1$ and $D_2$ may be formed by the weight of the respective marbles $M_1$ and $M_2$ as shown in FIG. 1C. Whereas depressions $D_1$ and $D_2$ of some sort are preferable in order to prevent the marbles $M_1$ and $M_2$ from moving in response to forces other than those resulting from the impact of a shooter marble, they are not necessary. If the depressions $D_1$ and $D_2$ are not preformed, the locations for the marbles $M_1$ and $M_2$ are designated by dots $d_1$ and $d_2$, but both depressions $D_1$ and $D_2$ and dots $d_1$ and $d_2$ may be used.

Figure 1D:
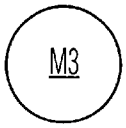
FIG. 1D is a marble or disk used as a shooter.

FIG. 1D shows a shooter marble $M_3$ that may or may not be the same weight and/or size as the marbles $M_1$ and $M_2$. As described in greater detail below, an object of the game is for a player to fire the shooter marble $M_3$ at either $M_1$ or $M_2$ in a manner to move either $M_1$ or $M_2$ without moving both.

Note that for purposes of description, the present game invention is described using marbles for one embodiment. In another embodiment, disk objects, such as dimes or pennies can be used in place of the marbles. If disk objects are used, no depressions are included on the associated playing surfaces, and $D_1$ and $D_2$ would be printed positions for placement of the disks on the playing surface.

Lines $L_1$ through $L_5$ that are parallel to a line joining the dots $d_1$ and $d_2$ and/or the depressions $D_1$ and $D_2$ are located at different respective distances from that line. Points to be earned by shooting a marble from shooting positions at any point along a line are indicated at ends of the lines. The points earned are approximately commensurate with the distance involved. By way of example, the points earned by shooting from shooting positions along the lines $L_1$ through $L_5$ may be respectively 5, 7, 10, 14, and 20 as indicated. Because of the geometry involved, it is easier to make a successful shot form the ends of the lines $L_1$ through $L_5$ than from any point along them.

Preferably, lines $L_6$ and $L_7$ that are perpendicular to a line joining dots $d_1$ and $d_2$ and/or the depressions $D_1$ and $D_2$ and which respectively pass through $d_1$ and $d_2$, and/or $D_1$ and $D_2$ are formed on the playing surface 2. As shown, a player making a successful shot from a shooting position at their end that is remote from the marbles $M_1$ and $M_2$ will earn a maximum number of points such as 75. Although this is very difficult, it gives a player with a low score a chance to win and thus maintain interest in the game.

Because the size of the marbles $M_1$ and $M_2$ in the drawings relative to the spacing of the lines $L_1$ through $L_7$ may make it appear that it would be difficult to locate the shooting positions from which a shot is made with great accuracy, the actual dimensions of the playing surface 2 are such that this is not the case. For example, the lines $L_1$ through $L_5$ may be six inches apart, and the lines $L_6$ and $L_7$ would be one-half inch apart if the marbles $M_1$ and $M_2$ are one-half inch in diameter. The distance between $L_1$ and a line passing through $d_1$ and $d_2$ and/or $D_1$ and $D_2$ could be eighteen inches. The widths of the playing surface 2 could be from twelve inches to twenty-four inches.

In playing a game, each player would be given a number of turns to fire a shooter marble $M_3$ such as shown in FIG. 1D, and each successful shot would earn a player the number of points designated at the end of the line from which the shot is made. The winning player is the one with the most points after a predetermined number of shots have been made.

The playing surface 2 can be formed on a rigid flat board or on a layer of foldable material, felt, for example, that can be placed on a flat firm surface such as a table.

Figure 2A:
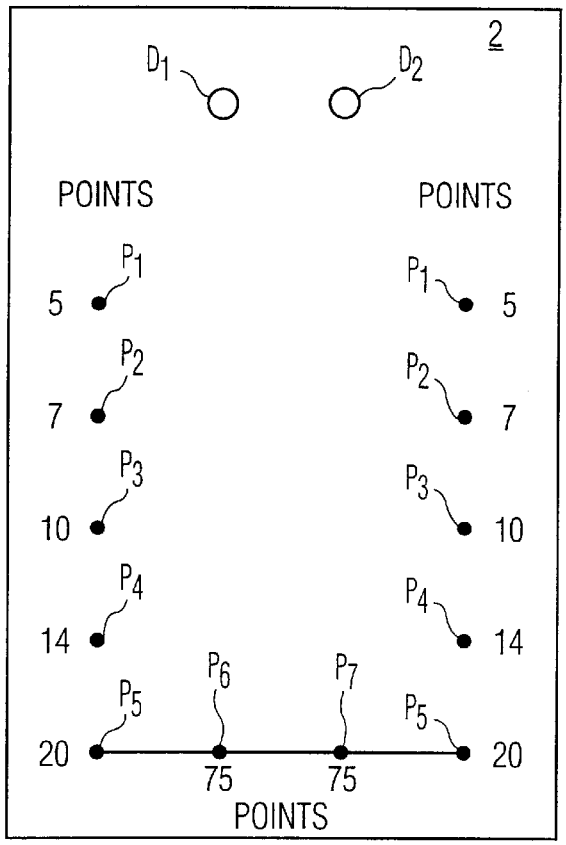
FIG. 2A illustrates the appearance of a playing surface in which shooting lines are replaced by shooting positions.

Whereas a playing surface could be as shown in FIG. 1A, shooting positions $P_1$ through $P_7$ at the ends of the lines $L_1$ through $L_7$ could be shown and the lines $L_1$ through $L_7$ eliminated as shown in FIG. 2A. Indicia of the shooting positions $P_1$ through $P_7$ other than dots could be used. The shooting positions $P_1$ through $P_5$ need only be shown along one side of the playing surface along with the one of $P_6$ and $P_7$ that is nearer that side, but it is preferable to show all shooting positions in order to accommodate left and right-handed players. In FIG. 2A, the playing surface 2 is made of hard material so that depressions $D_1$ and $D_2$ for the position of the marbles $M_1$ and $M_2$ are shown. Alternatively, in the second embodiment of the invention using disk objects, as previously indicated, $D_1$ and $D_2$ are printed positions, not depressions.

Figure 2B:
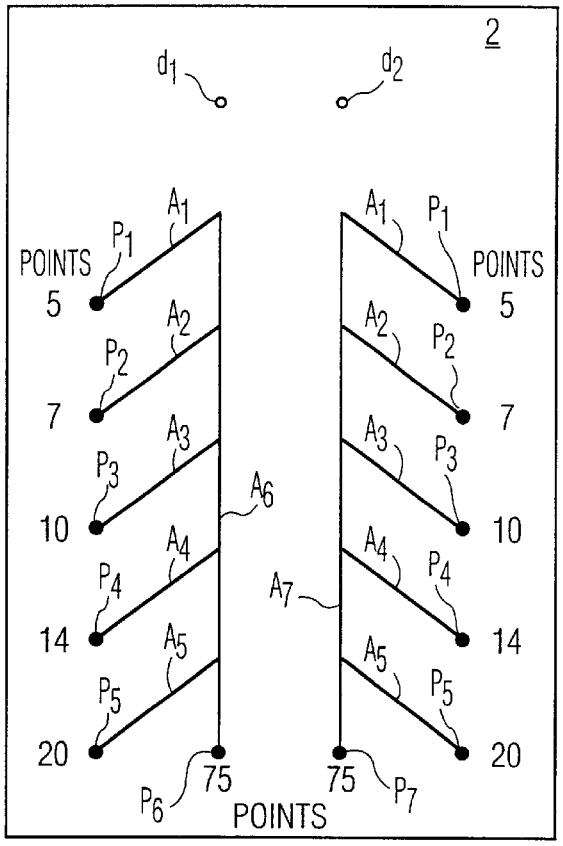
FIG. 2B illustrates the appearance of a playing surface in which aiming lines are shown for each shooting position.

The appearance of the playing surface shown in FIG. 2B is the same as that of FIG. 2A except that aiming lines $A_1$ through $A_7$ indicating the paths that are at the center of a range of permissible angles for successful shots from the shooting positions $P_1$ through $P_7$ are shown. In FIG. 2B, the playing surface 2 is made of material such as felt, for example, so that dots $d_1$ and $d_2$ are provided to show the positions of the marbles $M_1$ and $M_2$.

Figure 2C:
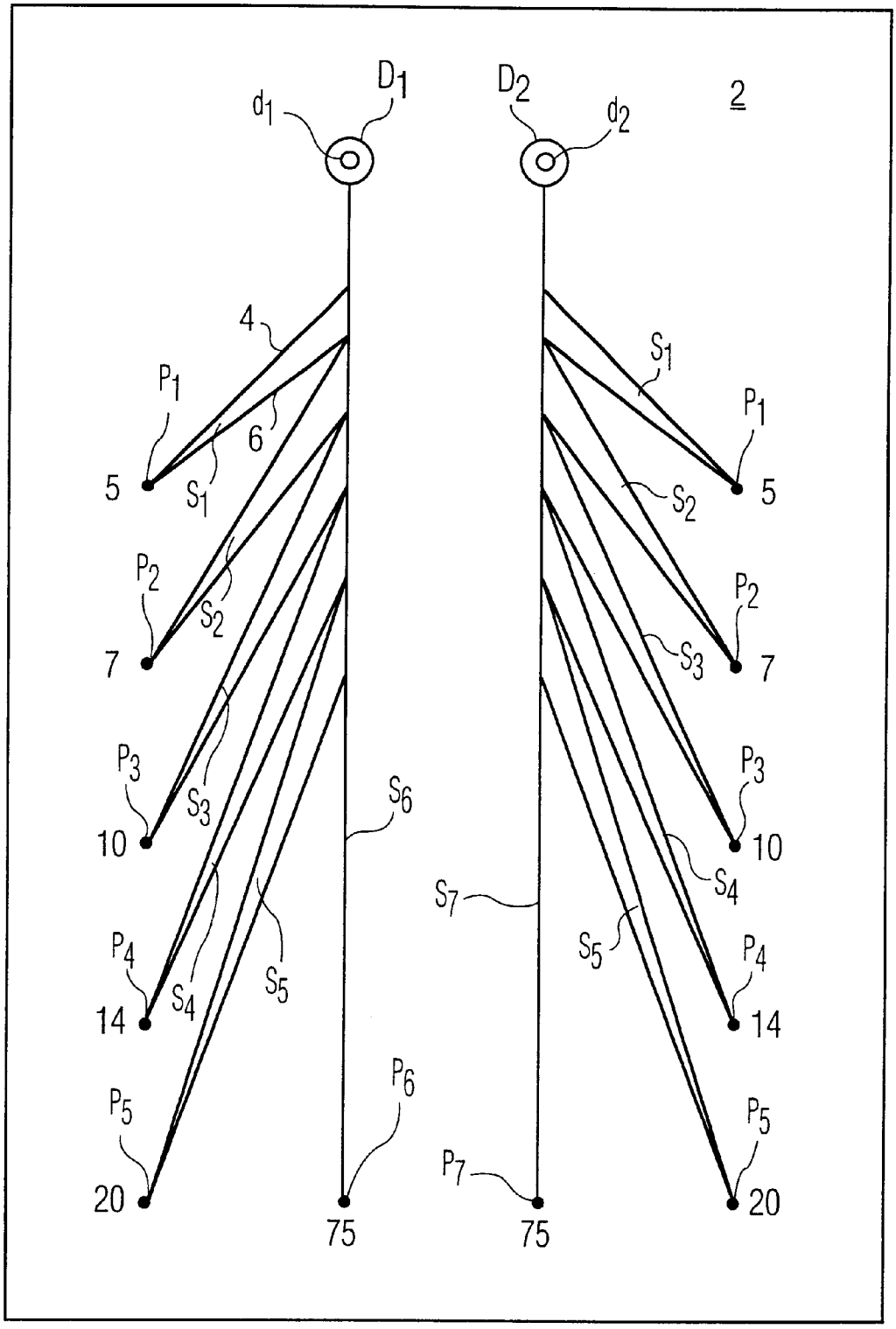
FIG. 2C illustrates the appearance of a playing surface in which aiming sectors are shown for each shooting position.

FIG. 2C is like FIG. 2A, but shows sectors $S_1$ through $S_7$ that represent the ranges of the angles for successful shots. Note, however, that the aiming lines $A_6$ or $A_7$ remain because a successful shot must follow $A_6$ or $A_7$ precisely. In FIG. 2C, the surface 2 is made of hard material having both depressions $D_1$ and $D_2$ and dots $d_1$ and $d_2$. The sectors $S_1$ through $S_7$ are defined as follows. Taking the sector $S_1$ as an example, a line 4 is drawn from $P_1$ that passes the marble $M_1$ at a distance that is slightly greater than a radius of the shooter marble $M_3$, and a line 6 is drawn $P_1$ that intersects the line $L_7$ at a distance from $D_2$ that is the sum of the radius of the marble $M_2$ and the radius of the shooter marble $M_3$.

Although various embodiments of the invention are shown and described herein, they are not meant to be limiting. Those of skill in the art may recognize certain modifications to these embodiments, which modifications are meant to be covered by the spirit and scope of the appended claims. For example, the playing surface 2 can be provided on a thin plastic or paper sheet that can be folded or rolled to pocket size for ultimate portability.

What is claimed is:

1. A marble game comprising:

a flat playing surface;

a shooter marble for aiming and shooting across the playing surface by a player;

two target marbles for stationary placement on the playing surface;

a pair of spaced-apart first indicia applied on said playing surface for indicating the stationary placement thereon of the two target marbles in contact with each other with their successive opposing diameters being aligned with a predetermined common horizontal plane, said first indicia lying in said common horizontal plane; and second indicia applied on said playing surface for indicating a plurality of shooting positions below or above the common horizontal plane of said two target marbles, from which the player can aim and shoot the shooter marble in an attempt to move one of said two target marbles away from the other, without also moving the other.

2. A marble game as set forth in claim 1, wherein said playing surface is on a rigid, flat board.

3. A marble game as set forth in claim 2, wherein the indicia for indicating the stationary placement of said at least two target marbles are depressions in said board.

4. A marble game as set forth in claim 1, wherein said playing surface is on a layer of foldable material such that the two marbles placed thereon form depressions therein.

5. A marble game as set forth in claim 1, wherein the second indicia for indicating the plurality of shooting positions are spaced lines that are parallel to said common horizontal plane of said two target marbles.

6. A marble game as set forth in claim 1, wherein said second indicia for indicating the plurality of shooting positions are at points spaced along locus lines that intersect lines passing through the pair of first indicia, respectively, said locus lines being on one side of each of the pair of first indicia.

7. A marble game as set forth in claim 1, wherein at least one said second indicia for indicating a shooting position is located at a point along a locus line that passes through one of the pair of first indicia for indicating the placement of said two target marbles, and is perpendicular to a vertical line passing through the other one of said pair of first indicia, said vertical line being perpendicular to said common horizontal plane.

8. A marble game as set forth in claim 7, wherein said locus line is designated on said playing surface.

9. A marble game as set forth in claim 1, wherein said playing surface is a layer of foldable material.

10. A disk game comprising:

a flat playing surface;

a shooter disk for aiming and shooting across the playing surface by a player;

two target disks for stationary placement on the playing surface;

a pair of first indicia applied on said playing surface for indicating the stationary placement thereon of the two target disks in contact with each other with their successive opposing diameters lying in a predetermined common horizontal plane; and second indicia applied on said playing surface for indicating a plurality of shooting positions below or above said common horizontal plane, from which the player can aim and shoot the shooter disk in an attempt to move one of said two target disks away from the other without also moving the other.

11. A disk game as set forth in claim 10, where said playing surface is on a rigid, flat board.

12. A disk game as set forth in claim 11, wherein the first indicia for indicating the placement of said at least two target disks are depressions in said board.

13. A disk game as set forth in claim 10, wherein said playing surface is on a layer of foldable material.

14. A disk game as set forth in claim 10, wherein said second indicia for indicating the plurality of shooting positions are spaced lines that are parallel to said horizontal plane of said two target disks.

15. A disk game as set forth in claim 10, wherein the second indicia for indicating the plurality of shooting positions are at points spaced along locus lines that intersect lines passing through the pair of first indicia, respectively, for indicating the placement of said two target disks, said locus lines being on one side of each of the pair of said first indicia.

16. A disk game as set forth in claim 10, wherein at least one of said second indicia for indicating a shooting position is located at a point along a locus line that passes through one of the pair of first indicia for indicating the placement of said two target disks, and is perpendicular to a vertical line passing through the other one of said pair of first indicia, said vertical line being perpendicular to said common horizontal plane.

17. A disk game as set forth in claim 16, wherein said locus line is designated on said playing surface.

18. A game having movable pieces consisting of marbles, or disk objects, said game comprising:

means for providing a flat playing surface;

a pair of first indicia applied on said means for providing the playing surface for indicating the placement of two target movable pieces to compel contact therebetween in a predetermined common horizontal plane; and second indicia applied on said means for providing the playing surface for indicating a plurality of shooting positions, below or above the common horizontal plane, of a shooter movable piece.

19. A game as set forth in claim 18, wherein said means for providing a playing surface is a rigid, flat board.

20. A game as set forth in claim 19, wherein the first indicia for indicating the placement of said two movable pieces are depressions in said board.

21. A game as set forth in claim 18, wherein said means for providing the playing surface is a layer of foldable material.

22. A game as set forth in claim 18, wherein the second indicia for indicating the plurality of shooting positions are spaced lines that are parallel to said common horizontal plane of said two movable pieces.

23. A game as set forth in claim 18, wherein said second indicia for indicating the plurality of shooting positions are at points spaced along locus lines that intersect lines passing through the pair of first indicia, respectively for indicating the placement of said two movable pieces, said locus lines being on one side of each of the said pair of first indicia.

24. A game as set forth in claim 18, wherein at least one said second indicia for indicating a shooting position is located at a point along a locus line that passes through one of the pair of first indicia for indicating the placement of said two movable pieces, and is perpendicular to a vertical line passing through the other one of said pair of first indicia, said vertical line being perpendicular to said common horizontal plane.

25. A game was set forth in claim 24, wherein said locus line is designated on said means for providing the playing surface.

* * * * *